US008146283B2

(12) United States Patent
Genes et al.

(10) Patent No.: US 8,146,283 B2
(45) Date of Patent: Apr. 3, 2012

(54) WEAPON MOUNTED ADAPTER

(75) Inventors: Mark A. Genes, South Mills, NC (US); Brandon R. Clarke, Bloomington, IN (US); Christopher Austin, Shirley, IN (US); Michael Holzmeyer, Bloomfield, IN (US); Daniel V. Jones, Mitchell, IN (US); Jeremy M. Knepp, Montgomery, IN (US); Lucius A. Taylor, French Lick, IN (US); Barry Gatewood, Bloomfield, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 143 days.

(21) Appl. No.: 12/651,198

(22) Filed: Dec. 31, 2009

(65) Prior Publication Data

US 2011/0100203 A1 May 5, 2011

Related U.S. Application Data

(60) Provisional application No. 61/256,943, filed on Oct. 30, 2009.

(51) Int. Cl.
*F41C 27/00* (2006.01)

(52) U.S. Cl. ..... 42/90; 42/124

(58) Field of Classification Search ..... 42/90, 111, 42/124–128, 71.01, 72, 106, 96, 75.01, 75.02; 89/9, 36.06
See application file for complete search history.

(56) References Cited

U.S. PATENT DOCUMENTS

| | | | | |
|---|---|---|---|---|
| 5,590,484 | A | 1/1997 | Mooney et al. | |
| 6,134,823 | A | 10/2000 | Griffin | |
| 6,490,822 | B1 * | 12/2002 | Swan | 42/71.01 |
| 6,499,245 | B1 * | 12/2002 | Swan | 42/71.01 |
| 6,508,027 | B1 | 1/2003 | Kim | |
| 6,618,976 | B1 * | 9/2003 | Swan | 42/114 |
| 6,655,069 | B2 | 12/2003 | Kim | |
| 6,694,660 | B1 * | 2/2004 | Davies | 42/75.01 |
| 6,779,288 | B1 | 8/2004 | Kim | |
| 6,782,652 | B1 | 8/2004 | Erickson | |
| 6,851,214 | B2 | 2/2005 | Oz | |
| 6,854,206 | B2 * | 2/2005 | Oz | 42/124 |
| 6,895,708 | B2 | 5/2005 | Kim et al. | |
| 7,117,624 | B2 | 10/2006 | Kim | |
| RE39,465 | E * | 1/2007 | Swan | 42/71.01 |
| 7,216,451 | B1 * | 5/2007 | Troy | 42/72 |
| 7,310,903 | B2 | 12/2007 | Kim | |
| 7,325,352 | B2 | 2/2008 | Matthews et al. | |
| RE40,216 | E * | 4/2008 | Swan | 42/71.01 |
| 7,360,333 | B2 | 4/2008 | Kim | |
| 7,363,741 | B2 * | 4/2008 | DeSomma et al. | 42/85 |
| 7,458,179 | B2 * | 12/2008 | Swan | 42/72 |

(Continued)

OTHER PUBLICATIONS

Dillon Aero, Inc.—M134D Minigun Product Information Guide, 2006, 40 pgs.

(Continued)

*Primary Examiner* — Michael Carone
*Assistant Examiner* — Jonathan C Weber
(74) *Attorney, Agent, or Firm* — Christopher A. Monsey

(57) ABSTRACT

An adapter for mounting on a weapon. The adapter illustratively includes a plurality of mounting rails for removably coupling with a variety of accessories, such as sights, illumination devices, and laser aiming devices.

16 Claims, 14 Drawing Sheets

U.S. PATENT DOCUMENTS

| | | | | |
|---|---|---|---|---|
| 7,493,720 | B1 | 2/2009 | Householder | |
| 7,562,484 | B2 | 7/2009 | Kim | |
| 7,591,098 | B2 | 9/2009 | Matthews et al. | |
| 7,669,359 | B2 * | 3/2010 | Kim | 42/124 |
| 7,707,762 | B1 * | 5/2010 | Swan | 42/85 |
| 7,765,730 | B2 * | 8/2010 | Keng | 42/111 |
| 7,793,452 | B1 * | 9/2010 | Samson et al. | 42/72 |
| 2004/0000083 | A1 * | 1/2004 | Grant, Jr. | 42/112 |
| 2005/0000142 | A1 * | 1/2005 | Kim et al. | 42/124 |
| 2005/0011104 | A1 * | 1/2005 | Oz | 42/124 |
| 2005/0241211 | A1 * | 11/2005 | Swan | 42/124 |
| 2006/0010748 | A1 * | 1/2006 | Stoner et al. | 42/71.01 |
| 2006/0288626 | A1 | 12/2006 | Kim | |
| 2007/0006509 | A1 * | 1/2007 | DeSomma et al. | 42/72 |
| 2008/0092423 | A1 * | 4/2008 | Keng | 42/111 |
| 2008/0134559 | A1 | 6/2008 | Swan | |
| 2008/0164392 | A1 | 7/2008 | Holmberg | |
| 2008/0168696 | A1 | 7/2008 | Orne et al. | |
| 2009/0101776 | A1 | 4/2009 | Peterson et al. | |
| 2010/0095575 | A1 * | 4/2010 | Swan | 42/72 |
| 2010/0154276 | A1 * | 6/2010 | Kim | 42/90 |
| 2010/0154280 | A1 * | 6/2010 | LaFrance et al. | 42/124 |
| 2010/0186278 | A1 * | 7/2010 | Daniel | 42/71.01 |
| 2010/0319231 | A1 * | 12/2010 | Stone et al. | 42/71.01 |
| 2011/0061281 | A1 * | 3/2011 | Kapusta et al. | 42/71.01 |

OTHER PUBLICATIONS

Military Standard, MIL-STD-1913 (AR), Dimensioning of Accessory Mounting Fail for Small Arms Weapons, Feb. 3, 1995, 10 pgs.

Surefire—HellFighter™ User Manual for M2HB .50 Cal Machine Gun, Jul. 1, 2008, 2 pgs., Fountain Valley, CA.

* cited by examiner

FIG. 12
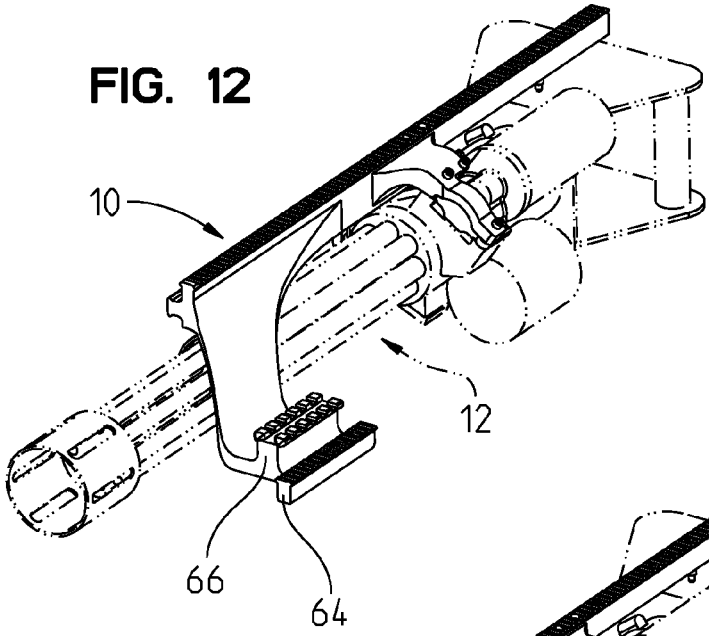
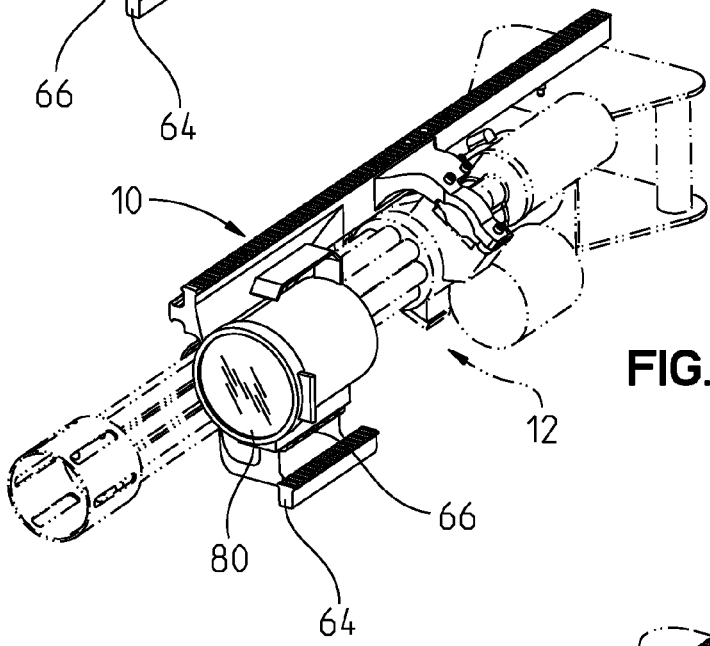
FIG. 13
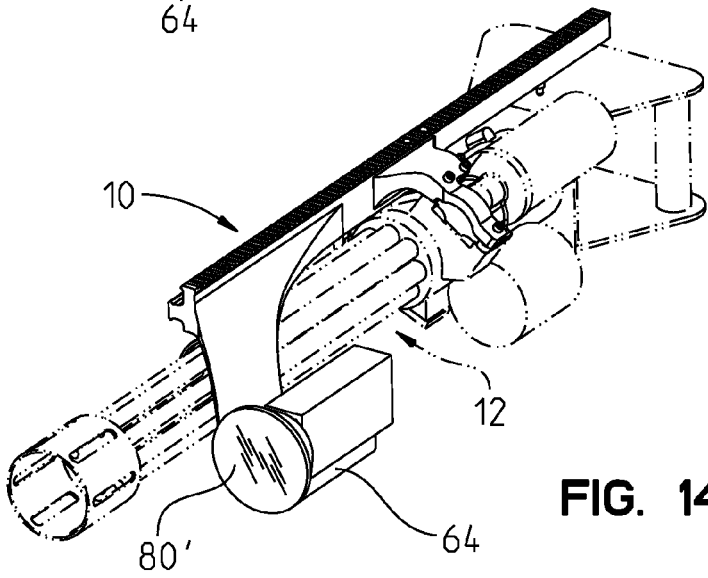
FIG. 14

WEAPON MOUNTED ADAPTER

CROSS-REFERENCE TO RELATED APPLICATION

This application claims priority to U.S. Provisional Patent Application Ser. No. 61/256,943, filed Oct. 30, 2009, the disclosure of which is expressly incorporated by reference herein.

STATEMENT REGARDING FEDERALLY SPONSORED RESEARCH OR DEVELOPMENT

The invention described herein includes contributions by one or more employees of the Department of the Navy made in performance of official duties and may be manufactured, used and licensed by or for the United States Government for any governmental purpose without payment of any royalties thereon.

BACKGROUND AND SUMMARY OF THE DISCLOSURE

The present invention relates generally to firearms and, more particularly, to a weapon mounted adapter system for mounting accessories to the firearm.

The increasing demands and complexity of strategic missions has resulted in a need for weapons with a number of accessories, such as optical sights, flashlights, range finders, laser designators, and night vision scopes. As a result, various mounts for weapons have been developed to facilitate the mounting of accessories proximate to the weapon barrels.

The present disclosure relates to a weapon mounted platform for the simultaneous and concurrent attachment and use of various accessories, such as sights, illumination devices, and optical devices, in connection with fire control of a weapon, such as an MK 44 Minigun, for enhancing initial round accuracy. The platform is further configured to reduce and/or eliminate splash-back of illumination devices and passive aiming lasers when used in conjunction with protective shields.

According to an illustrative embodiment of the present disclosure, an adapter for mounting on a weapon includes a support having a center portion intermediate opposing proximal and distal ends. A longitudinally extending first inboard mounting rail extends between the proximal and distal ends of the support. A longitudinally extending second inboard mounting rail is positioned proximate the distal end of the support, extends parallel to, and is angularly offset from the first inboard mounting rail. A tail extends laterally outwardly from the distal end of the support. A first outboard mounting rail is supported by the tail. A stabilizing member illustratively extends laterally outwardly from the support and is positioned intermediate the proximal and distal ends thereof. The support illustratively includes an arcuate arm configured to conform to a circumference of the weapon, and to be secured to the weapon. Accessories may be removably coupled to the mounting rails.

According to a further illustrative embodiment of the present disclosure, a method of supporting accessories on a weapon includes the steps of attaching an adapter to the weapon, the adapter including a longitudinally extending beam and a laterally extending tail, and coupling a first accessory to a first mounting rail supported by the beam proximate a proximal end of the beam. The method further includes the step of coupling a second accessory to a second mounting rail supported by the tail and spaced laterally from the beam proximate a distal end of the beam.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

FIGS. 12-14 are perspective views of illustrative accessory mounting options in connection with the adapter of FIG. 1;

Figure 1:
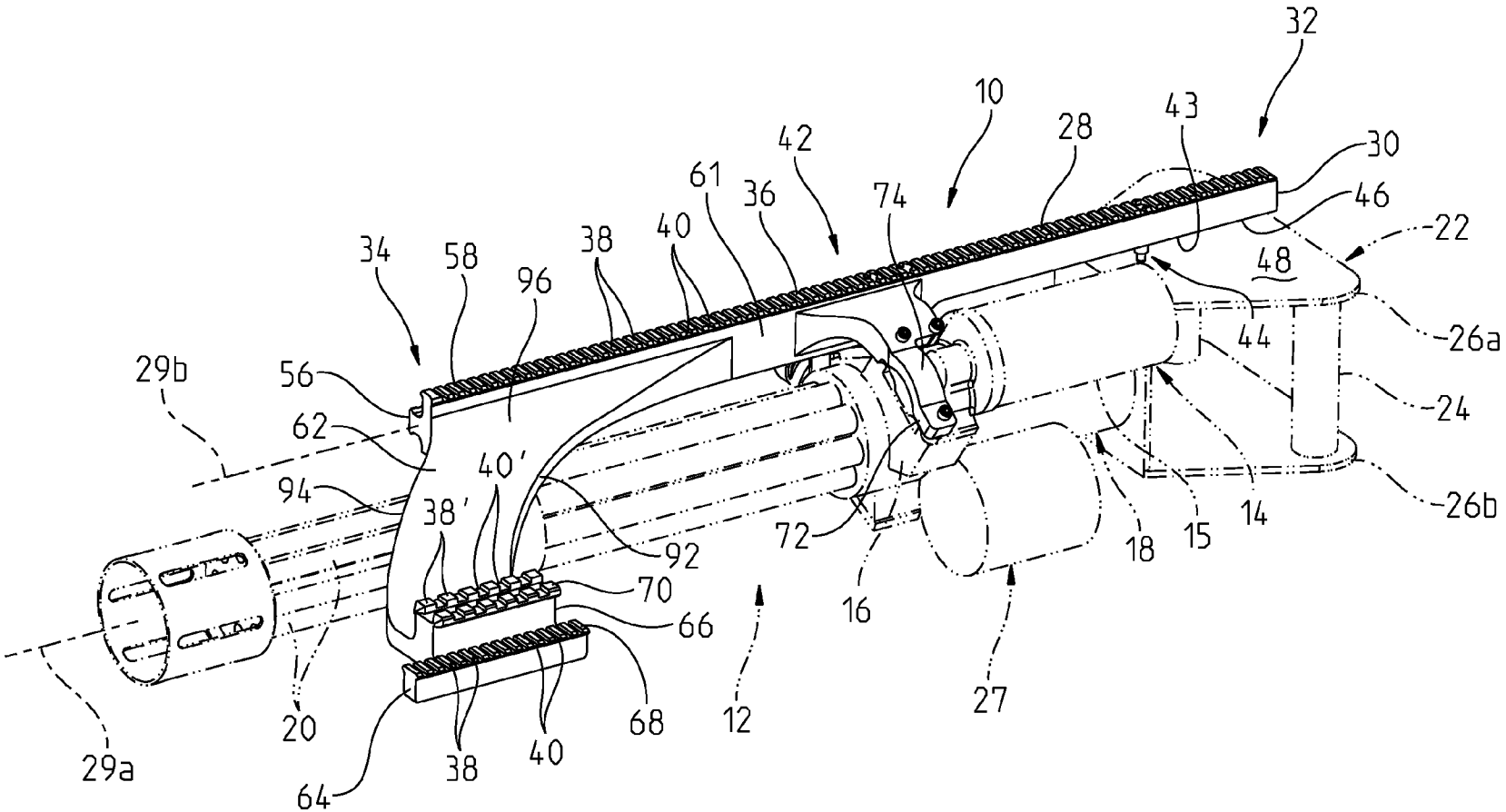
FIG. 1 is a right front perspective view of an illustrative adapter showing the weapon in phantom.
Figure 2:
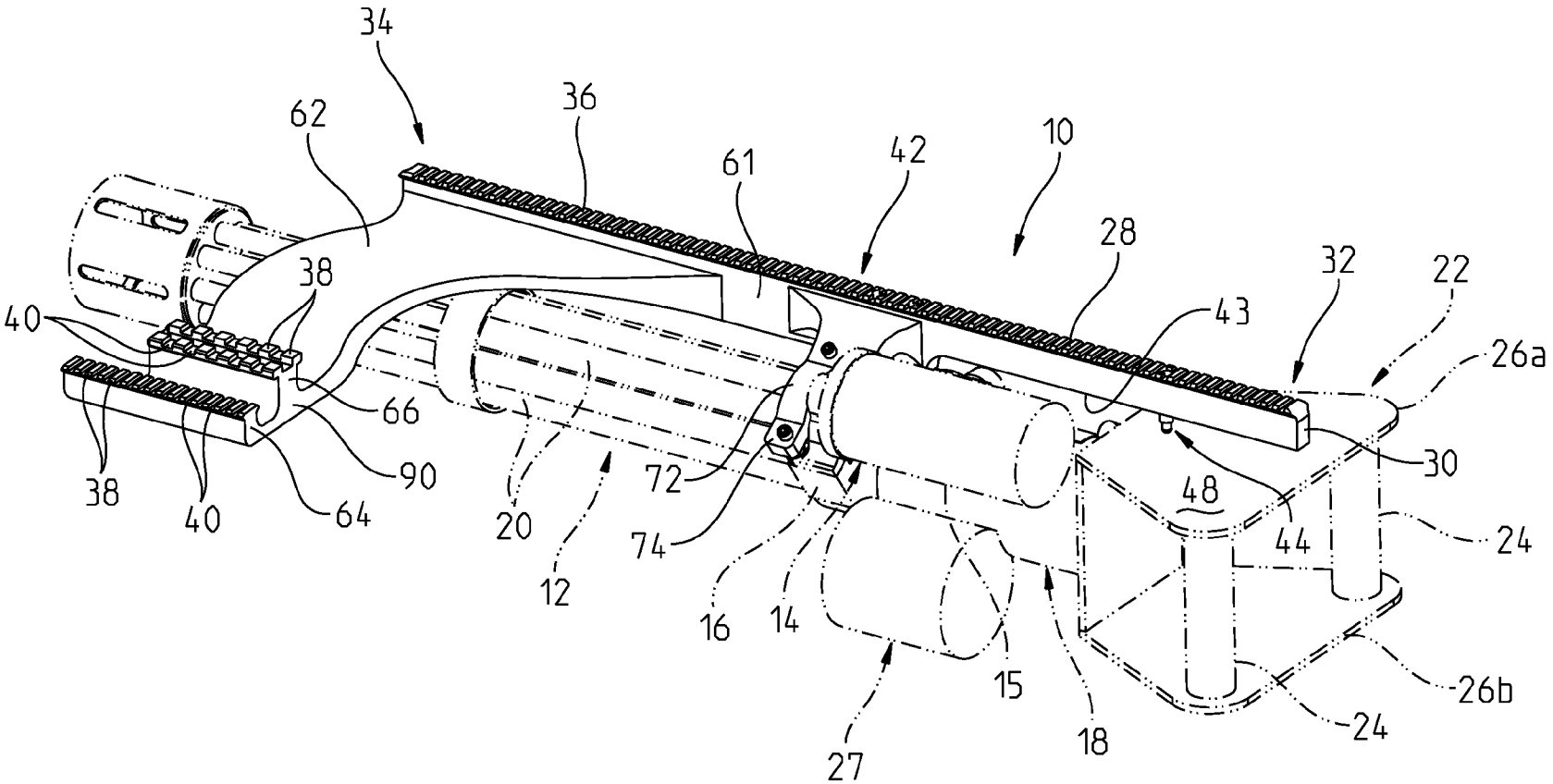
FIG. 2 is a right rear perspective view similar to FIG. 1.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended.

The invention includes any alterations and further modifications in the illustrated devices and described methods and further applications of the principles of the invention which would normally occur to one skilled in the art to which the invention relates.

Referring initially to FIGS. 1-6, an illustrative adapter 10 is shown mounted to a weapon 12. Illustratively, the weapon 12 comprises a machine gun, such as an MK 44 Minigun, although other weapons may be substituted therefor. Variations of the MK 44 Minigun are also known, such as the GAU 17 or M134D Gatling Gun available from Dillon Aero, Inc. of Scottsdale, Ariz.

As known, the weapon 12 illustratively includes a drive assembly 14 including a motor 15 operably coupled to a gear head 16. The gear head 16 is configured to drive a rotor assembly 18 in rotation. The rotor assembly 18 is operably coupled to a plurality of barrels 20 which rotate during firing to discharge rounds in a rapid succession (typically 3,000 rounds per minute). More particularly, the barrels 20 rotate as the weapon 12 is fired, such that a single barrel 20*a* is active and discharging rounds. A spade grip 22 is supported by the drive assembly 14 and includes a pair of handles 24 to be gripped by a gunner and extending between upper and lower support plates 26*a* and 26*b*. A feeder/delinker 27 may be provided to delink and feed belted ammunition to the weapon 12.

Figure 9:
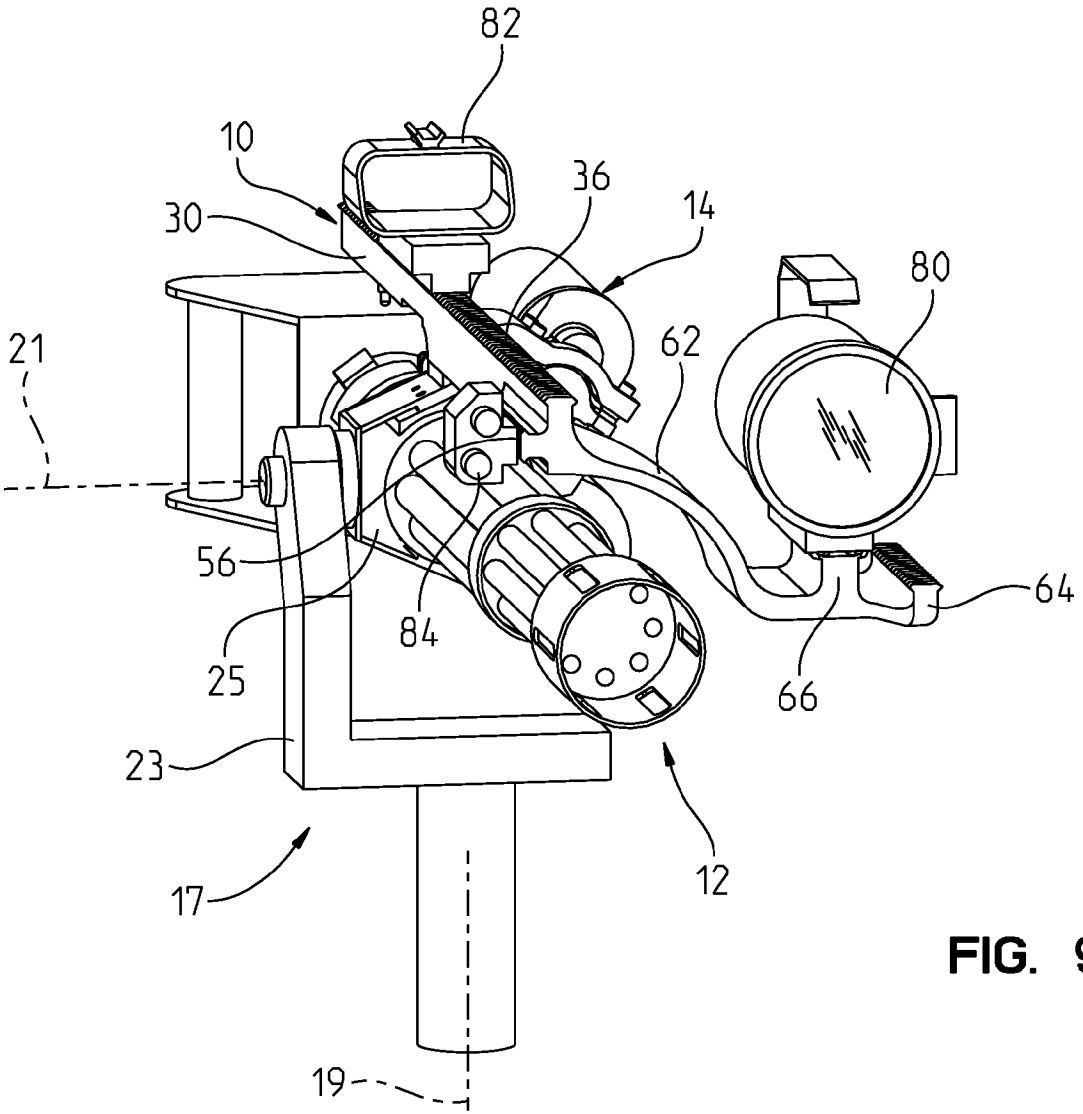
FIG. 9 is a front perspective view of the adapter of FIG. 1 coupled to a weapon supported by a mount.

In the illustrative embodiment of FIG. 9, a gun mount 17 may support the weapon 12 for rotation about vertical and horizontal axes 19 and 21, respectively. The gun mount 17 illustratively includes a vertical arm 23 supporting a yoke 25. The arm 23 may be coupled to a base (not shown) for rotation about the vertical axis 19. The yoke 25 is illustratively secured to the weapon 12 and supported by the arm 23 for rotation about the horizontal axis 21. The gun mount 17 may be of the type available from Dillon Aero, Inc.

As used herein, "proximal" describes a direction toward the grip 22 of the weapon 12; "distal" describes an opposite direction toward the open end or muzzle of the barrels 20; "longitudinal" means in a direction generally along or parallel to a longitudinal axis 29*a* of the weapon 12; "lateral" or "transverse" means in a direction generally perpendicular to the longitudinal direction; and "inboard" means a component is located relatively closer to the longitudinal axis 29*a* of the weapon 12 than an "outboard" component.

Figure 4:
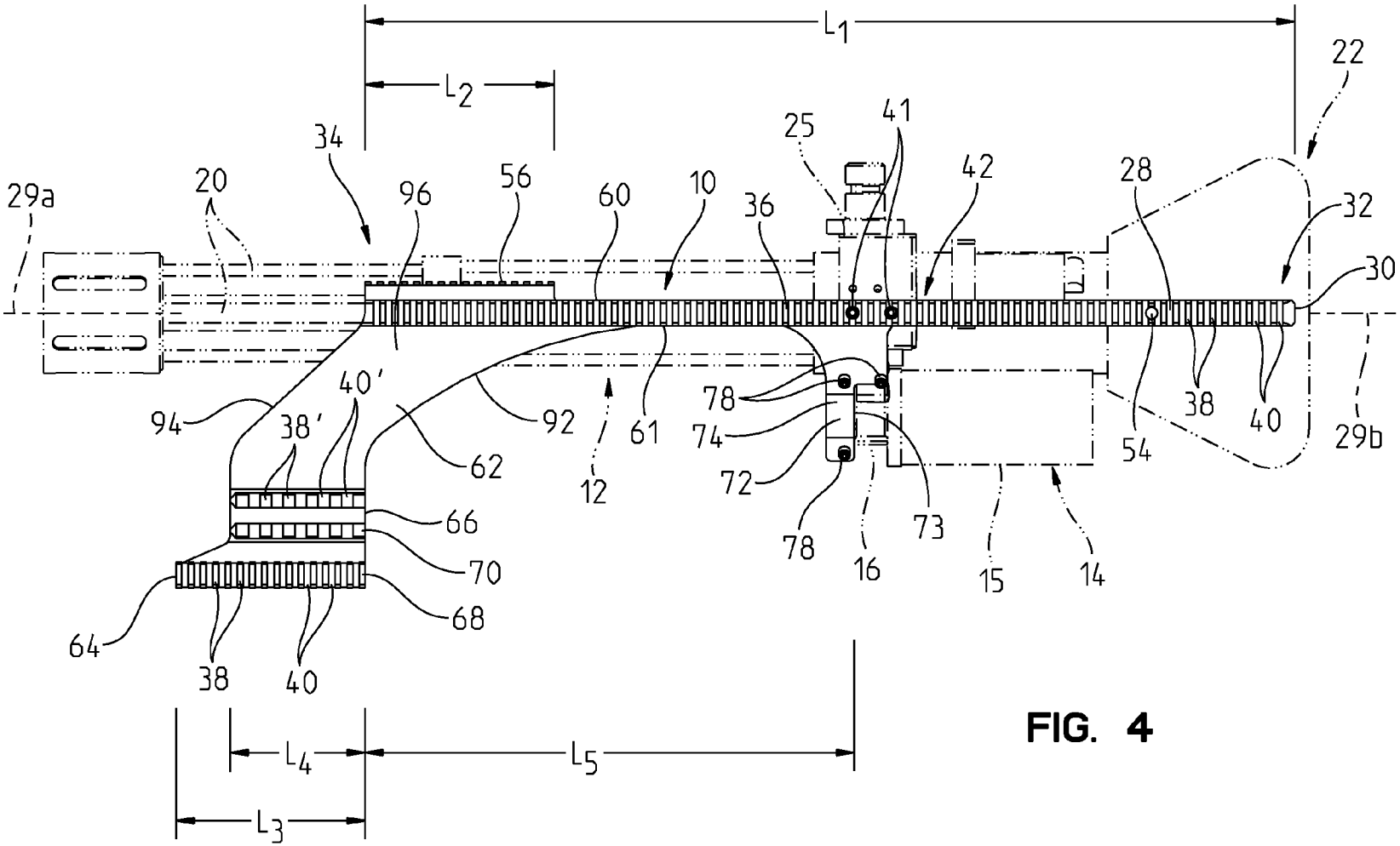
FIG. 4 is a top plan view of the adapter and weapon of FIG. 1.
Figure 15:
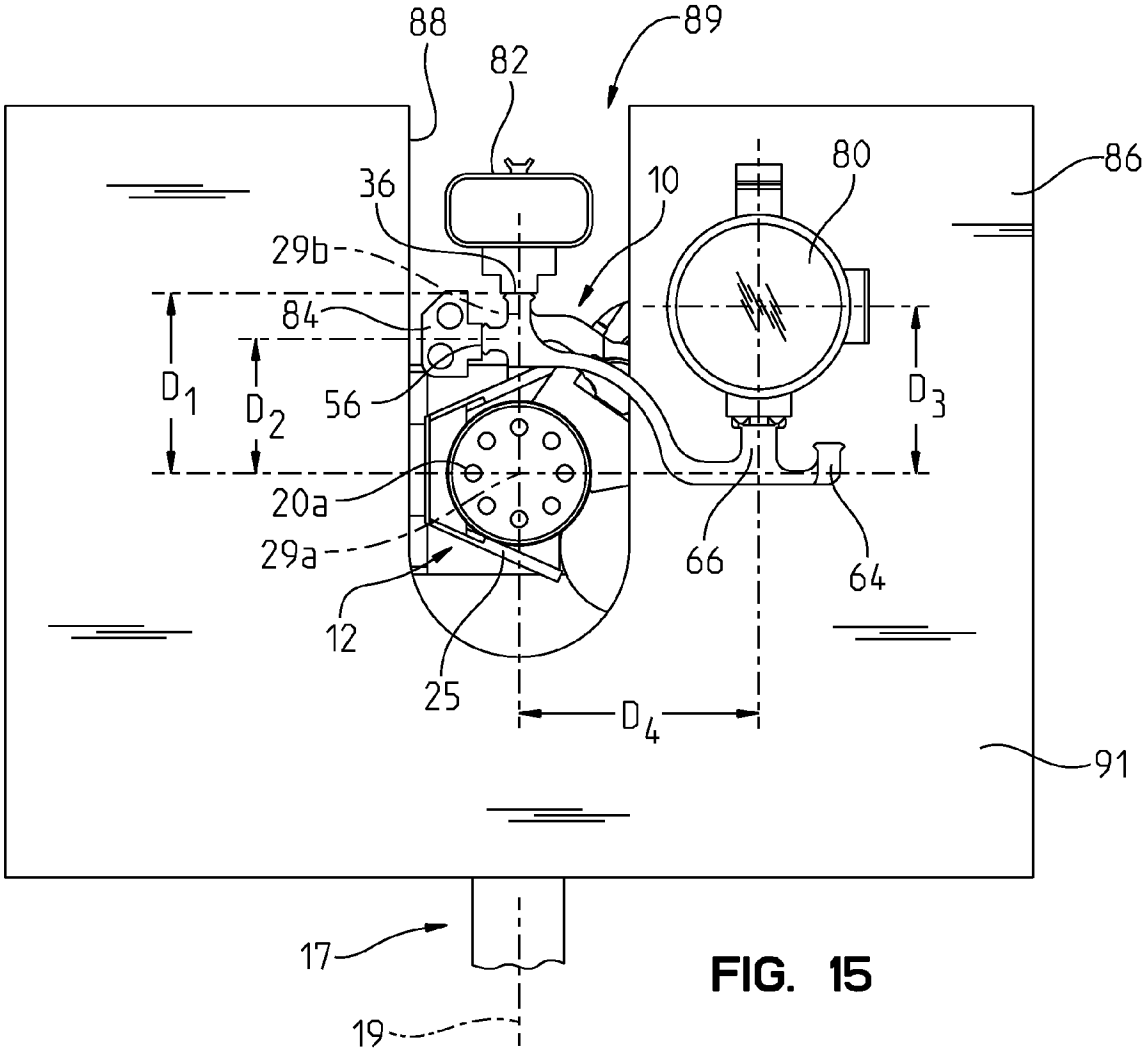
FIG. 15 a front view of the adapter, weapon, and mount of FIG. 9, with a protective shield supported intermediate opposing ends of the weapon.

The adapter 10 includes a support 28, illustratively a beam 30, extending between opposing proximal and distal ends 32 and 34 along a longitudinal axis 29*b*. As shown in FIGS. 1, 4 and 15, the longitudinal axis 29*b* of the beam 30 extends parallel to the longitudinal axis 29*a* of the weapon 12, and illustratively within the same vertical plane. Illustratively, the beam 30 may be formed of an aluminum which may be subsequently treated or coated. For example, the beam 30 may be a multi-planed, 7075 T651 hard coated anodized aluminum. The beam 30 has a length $L_1$ extending between opposing ends 32 and 34 (FIG. 4). In the illustrative embodiment, the length $L_1$ is approximately 30 inches.

A longitudinally extending first inboard mounting rail 36 is supported by the beam 30 and extends within a first mounting plane 31 between the proximal and distal ends 32 and 34 thereof (i.e., approximately 30 inches in length). In the illustrative embodiment shown in FIG. 5, the rail 36 is formed integral with the beam 30. However, as further detailed herein, the rail 36 may be a separate component coupled to the beam 30. The rail 36 may be of any suitable shape and size, but illustratively is a Picatinny rail. More particularly, the rail 36 illustratively includes a plurality of longitudinally spaced-apart ribs 38 separated by transverse slots 40, such as the Picatinny rail specified in MIL-STD-1913, which is incorporated by reference herein.

Figure 5:
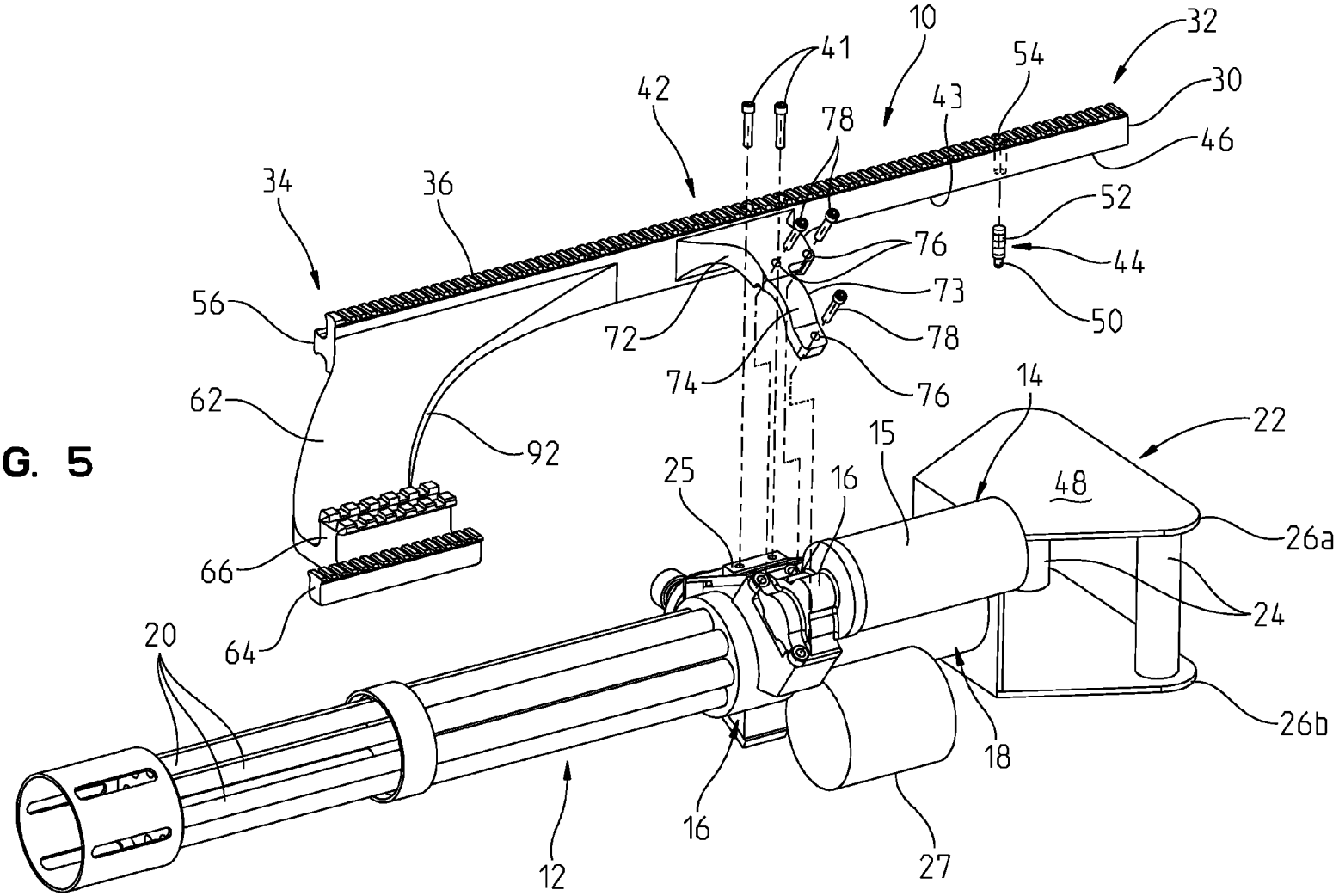
FIG. 5 is a partially exploded perspective view of the adapter and weapon of FIG. 1.
Figure 7:
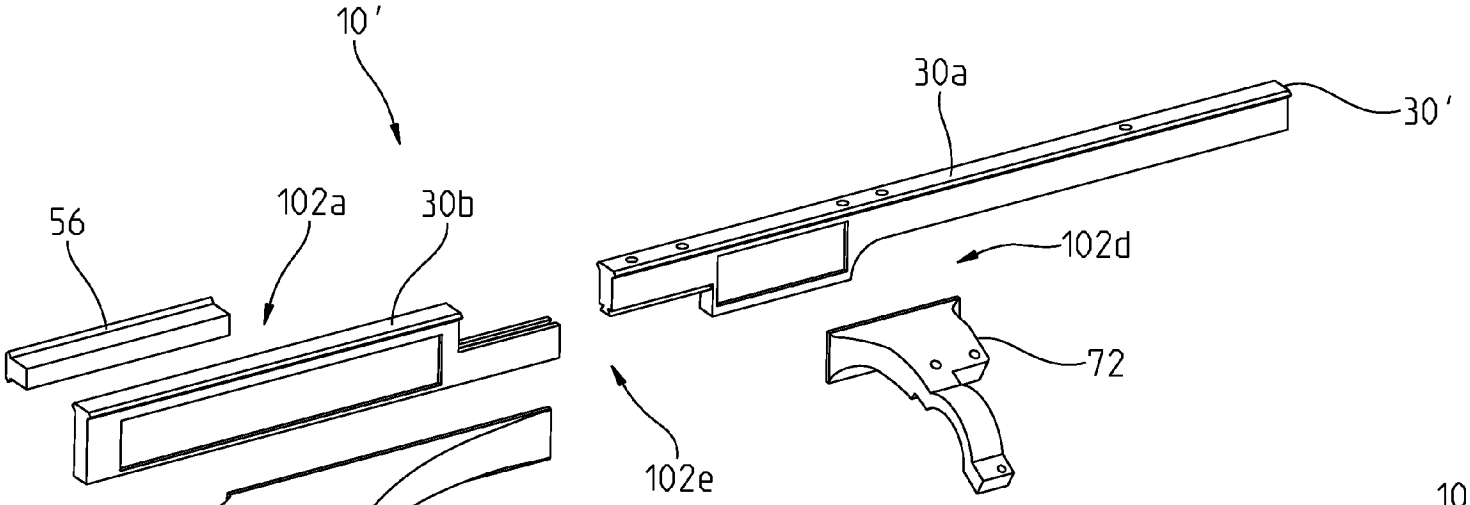
FIG. 7 is an exploded perspective view of an illustrative modular adapter.

The beam 30 is cantilevered above the weapon 12 in opposing directions from a center or mounting portion 42. With reference to FIGS. 4 and 5, a pair of fasteners, illustratively bolts 41, secure the center portion 42 of the beam 30 to the weapon 12. With reference to FIGS. 5 and 7, the bolts 41 illustratively secure the center portion 42 of the beam 30 to the yoke 25 of the gun mount 17. It should be appreciated that in other illustrative embodiments, the beam 30 may be secured to other structural features of the weapon 12.

With reference to FIG. 5, the proximal end 32 of the beam 30 includes a recess 43 to provide clearance for the drive assembly 14 of the weapon 12. A bearing member 44 is supported by the lower surface 46 of the beam 30 near the proximal end 32 and is configured to bear against a top surface 48 of the upper plate 26*a*. The bearing member 44 illustratively comprises a spring plunger including a polymeric bearing pin 50 spring biased outwardly from a housing 52 to contact top surface 48 of the upper plate 26*a*. The housing 52 is illustratively threadedly received within an aperture 54 extending into the lower surface 46 of the beam 30. As such, the bearing member 44 helps support the cantilevered proximal end 32 of the beam 30.

A longitudinally extending second inboard mounting rail 56 is supported proximal the distal end 34 of the beam 30 is angularly offset from the first inboard mounting rail 36. Illustratively, the second inboard mounting rail 56 is angularly offset about the longitudinal axis 29*b* by 90 degrees from the first inboard mounting rail 36. As such, the first inboard mounting rail 36 extends upwardly from an upper surface 58 of the beam 30, while the second inboard mounting rail 56 extends laterally outwardly from a first side surface 60 of the beam 30. In other words, the second inboard mounting rail 56 extends within a second mounting plane 57 perpendicular to the first mounting plane 31. In the illustrative embodiment shown in FIG. 5, the mounting rail 56 is formed integral with the beam 30. However, as further detailed herein, the rail 56 may be a separate component coupled to the beam 30. The second inboard mounting rail 56 is illustratively a Picatinny rail conforming to MIL-STD-1913, similar to the first inboard mounting rail 36, and has a length $L_2$ (FIG. 4) of approximately 6 inches.

Figure 6:
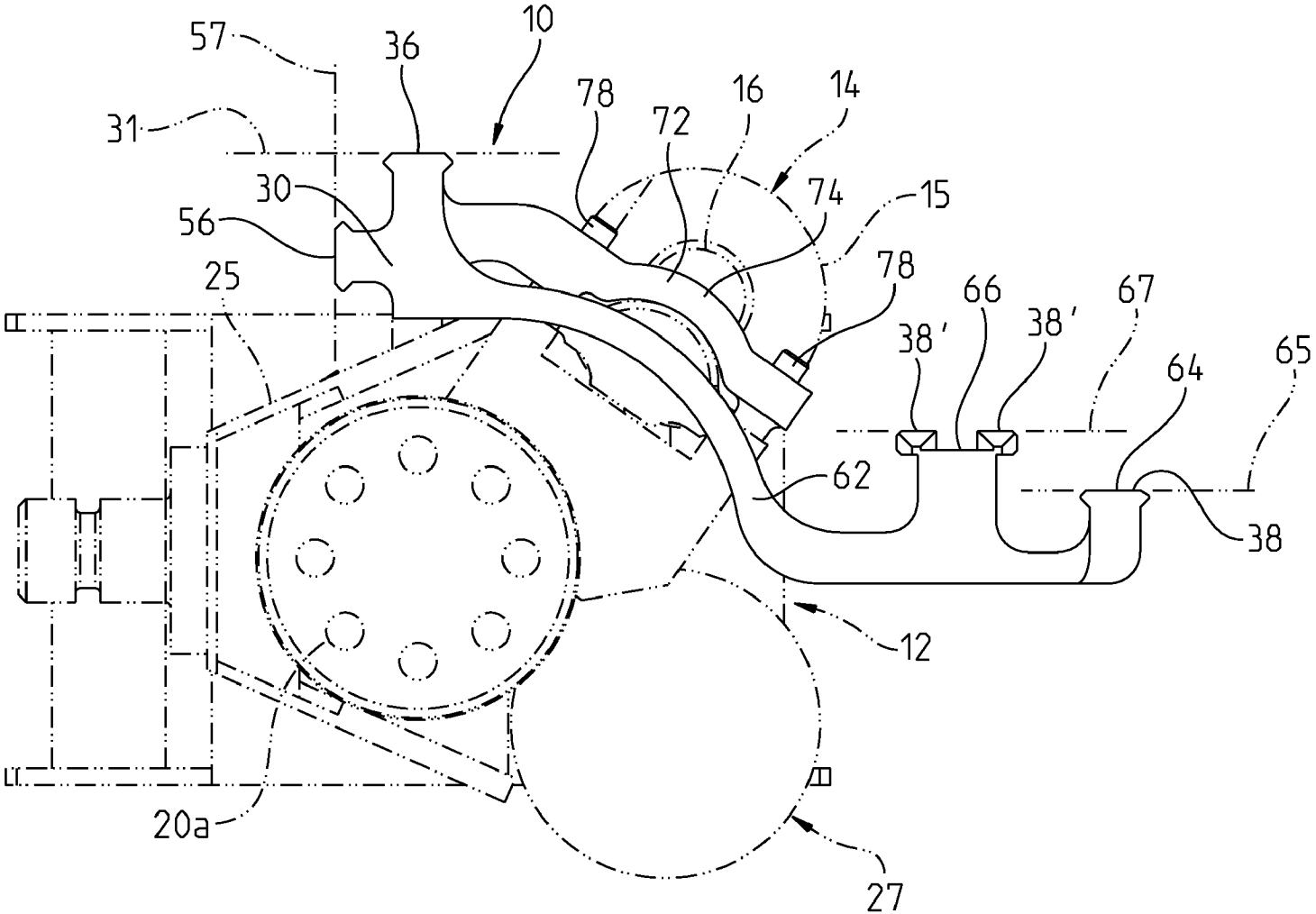
FIG. 6 is a front end view of the adapter and weapon of FIG. 1.

A distal extension or tail 62 extends laterally outwardly and longitudinally forwardly of the beam 30. The tail 62 is cantilevered outwardly from a second side surface 61 of the beam 30 and is curved downwardly to provide clearance for the barrels 20 of the weapon 12 (FIG. 6). More particularly, the tail 62 includes an arcuate arm or body 63 that conforms to the circumference of the weapon 12 as defined by the barrels 20. In the illustrative embodiment shown in FIG. 5, the tail 62 is formed integral with the beam 30. However, as further detailed herein, the tail 62 may be a separate component coupled to the beam 30.

Auxiliary or outboard mounting rails 64 and 66 are supported at a lateral end of the tail 62. Illustratively, a first outboard mounting rail 64 is supported by an outside lateral edge of the tail 62, and a second outboard mounting rail 66 is supported laterally inwardly thereto. In the illustrative embodiment shown in FIG. 5, the outboard mounting rails 64 and 66 may be formed integral with the tail 62. However, as further detailed herein, the outboard mounting rails 64 and 66 may be separate components coupled to the tail 62. As shown in FIG. 7, the outboard mounting rails 64 and 66 may be combined on opposing upper and lower portions of a support 69 extending vertically relative to the tail 62. By extending from opposing upper and lower portions of the support 69, the desired mounting surface 68 and 70 may be accessible from above by rotating the support 69 by 180 degrees about its longitudinal (e.g. horizontal) axis.

The outboard mounting rails 64 and 66 may have various mounting surfaces 68 and 70, such as the aforementioned MIL-STD-1913 or customized mounting surfaces for different accessories. In one illustrative embodiment, the first outboard mounting rail 64 is similar to the second inboard mounting rail 56, and has a length $L_3$ of approximately 6 inches (FIG. 4). The first outboard mounting rail 64 extends within a third mounting plane 65 parallel to, and positioned vertically below, the first mounting plane 31 (FIG. 6). The second outboard mounting rail 66 may include customized spacing of ribs 38' and slots 40' for supporting specialized accessories, such as an illumination device or target illuminator available from SureFire® of Fountain Valley, Calif., and has a length $L_4$ of approximately 4.4 inches (FIG. 4). The second outboard mounting rail 66 extends within a fourth mounting plane 67 parallel to, and positioned vertically above, the third mounting plane 65 (FIG. 6).

A stabilizing member 72 illustratively extends laterally outwardly from the center portion 42 of the beam 30 intermediate the proximal and distal ends 32 and 34. In the illustrative embodiment shown in FIG. 5, the stabilizing member 72 is formed integral with the beam 30. However, as further detailed herein, the stabilizing member 72 may be a separate component coupled to the beam 30.

Stabilizing member 72 illustratively includes an arcuate arm 74 that is configured to follow the contour or circumference of the drive assembly 14 of the weapon 12 by extending laterally outwardly and vertically downwardly from the beam 30. The arm 74 includes a plurality of mounting apertures 76 for receiving fasteners, such as screws 78, configured to couple with the existing mounting points of the weapon 12 (FIG. 5). For instance, mounting screws 78 for the gear head 16 may be utilized to support the stabilizing member 72 to the drive assembly 14 of the weapon 12. The arcuate arm 74 may include a cutout or recess 73 configured to conform to the shape of the gear head 16 (FIG. 4).

Figure 3:
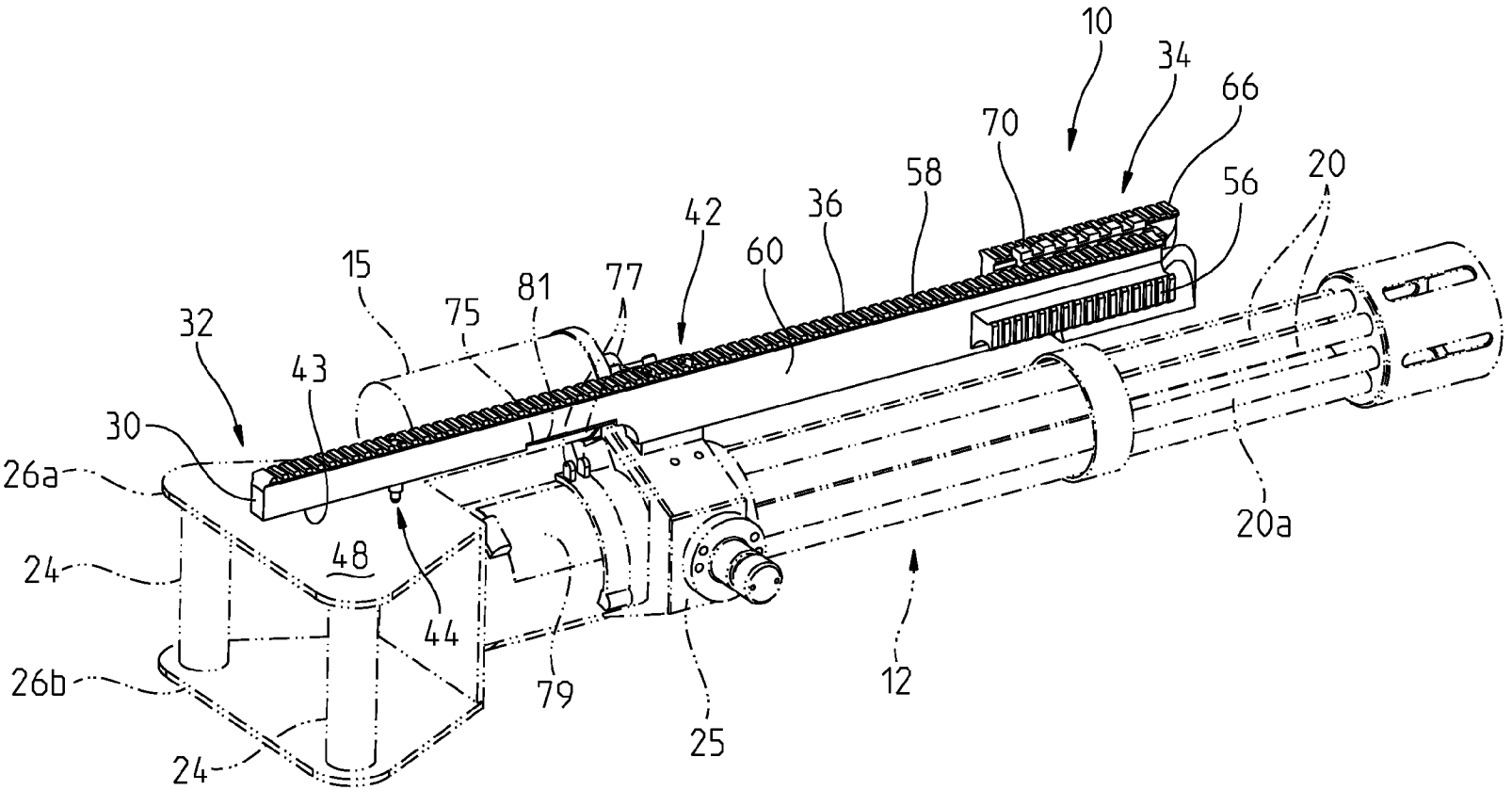
FIG. 3 is a left rear perspective view of the adapter of FIG. 1, with the weapon shown in phantom.

As shown in FIG. 3, the beam 30 includes a recess or notch 75 in the lower surface 46 to permit user access to spring biased latch pins 77 of a cover or door 79 of weapon 12. As is known, the door 79 may be pivoted open after the latch pins 77 are released by pinching them towards each other. Access through the door 79 may be desired, for example, to service and/or maintain the weapon 12. In one illustrative embodiment, the door 79 may form part of a top cover/safing sector assembly accessible to ensure that all chambers are clear of ammunition and safe the weapon 12. A chamfered or inclined surface 81 is provided to facilitate tool (e.g. screwdriver) access to the door 79.

Figure 8:
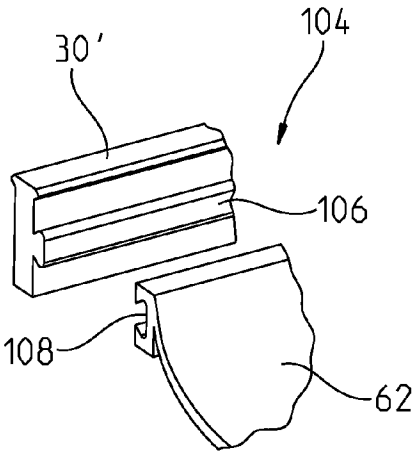
FIG. 8 is a detail perspective view of an illustrative coupling of the adapter of FIG. 7.

With reference to FIGS. 7 and 8, a modular embodiment adapter 10' is shown as including separable and removable components as opposed to the integrally formed components of the adapter 10 detailed above. Multiple separable components may reduce the time and cost associated with manufacturing of the adapter 10'. As shown, a plurality of separation points 102*a*, 102*b*, 102*c*, 102*d*, and 102*e* are defined by releasable couplers. For example, separation point 102*a* is illustratively defined between the beam 30' and the second inboard mounting rail 56. It should be appreciated that the first inboard mounting rail 36 may likewise be removably coupled to the beam 30' by releasable coupler (not shown). A separation point 102*b* may be defined between the tail 62 and the beam 30', and a separation point 102*c* may be defined between the outboard mounting rails 64 and 66 and the tail 62. Further illustratively, a separation point 102*d* may be defined between the stabilizing member 72 and the beam 30'. With further reference to FIG. 7, the beam 30' may include a proximal portion 30*a* and a distal portion 30*b* coupled together at a separation point 102*e*.

The releasable couplers defining the separation points 102 may comprise any suitable coupling arrangement. As shown in FIG. 8, an interlocking joint may be defined by a dovetail coupler 104 including a tongue 106 slidably received within a groove 108. Conventional fasteners (not shown) may be used in addition to, or instead of, the dovetail coupler 104 to secure the respective removable components together.

The mounting rails 36, 56, 64, and 66 may be utilized to support a variety of weapon supplemental devices and accessories, such as for example, electronic devices, scopes, sights, lights, lasers, adapters, and any other desired gear. For example, as shown in FIG. 9, an illumination device, such as a target light 80 may be supported on the outboard mounting rail 66, while an optical sight 82 may be supported on the first inboard mounting rail 36, and a range finder 84 may be supported on the second inboard mounting rail 56. FIGS. 12-14 illustrate various accessory mounting configurations including no accessories (FIG. 12), a first illuminating device 80 mounted to the second outboard mounting rail 66 (FIG. 13), and a second illuminating device 80' mounted to the first outboard mounting rail 64 (FIG. 14).

Figure 10:
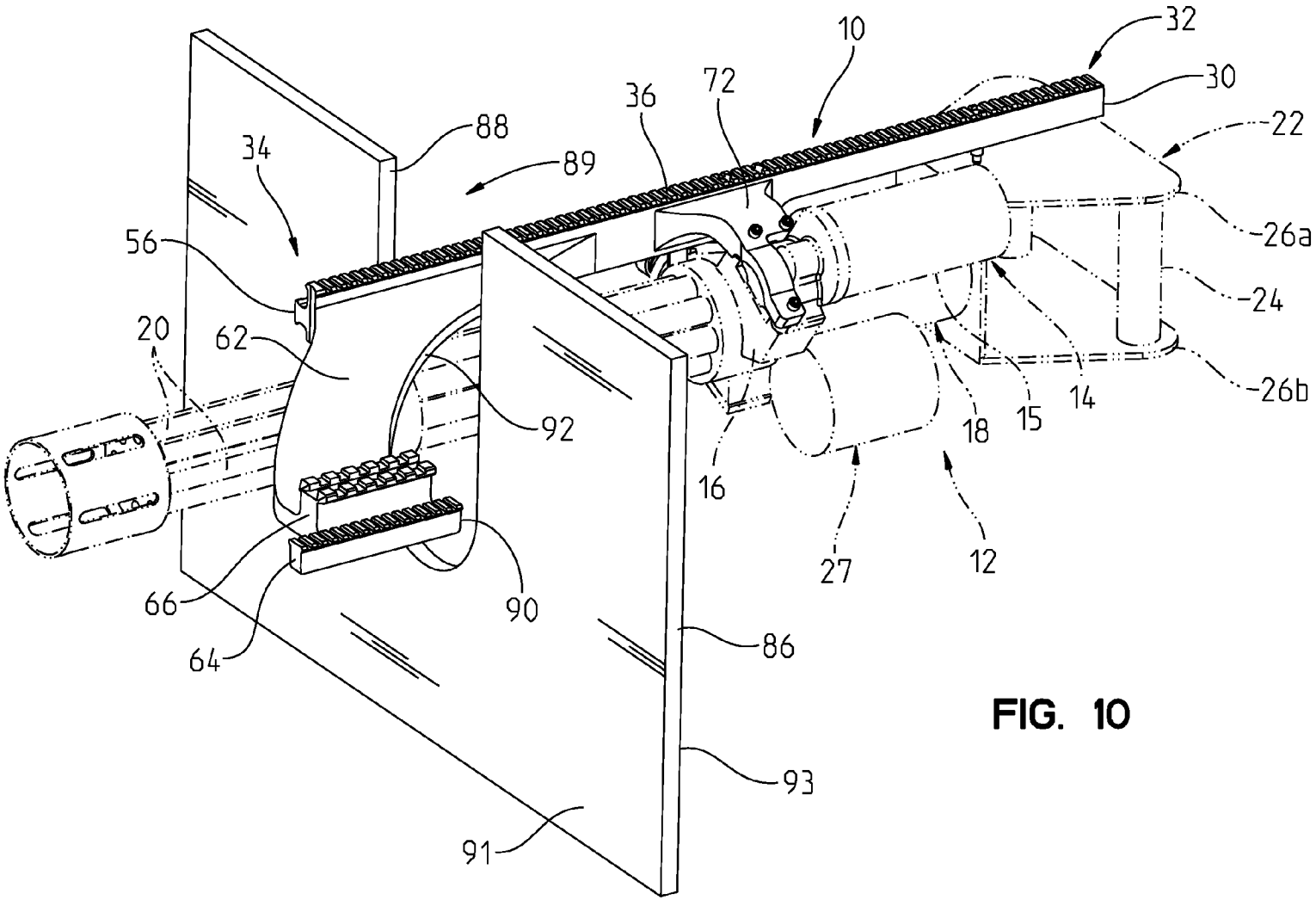
FIG. 10 is a perspective view similar to FIG. 1, showing the adapter and weapon extending through a protective shield.
Figure 11:
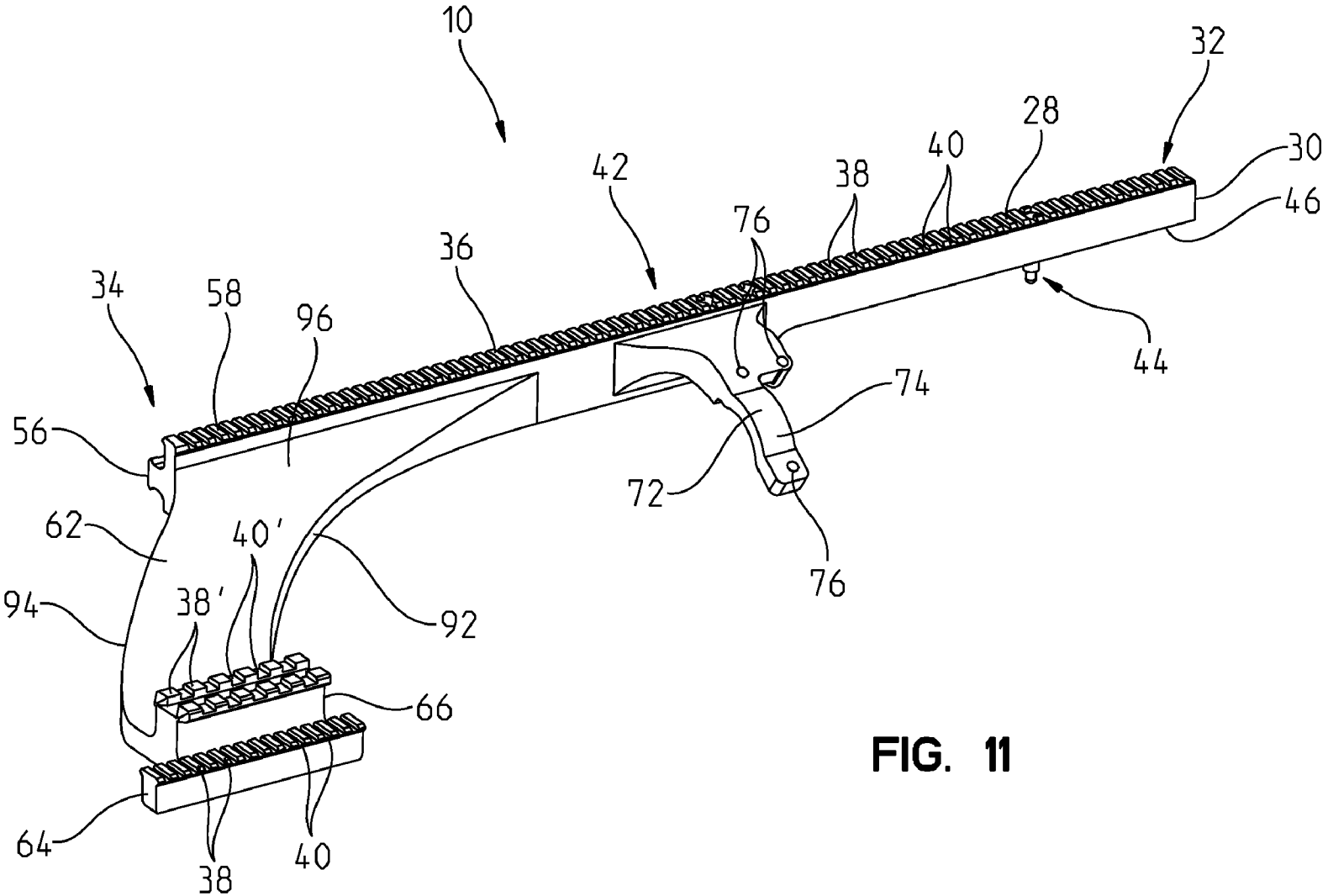
FIG. 11 is a front right perspective view of the adapter similar to FIG. 1.
Figure 16:
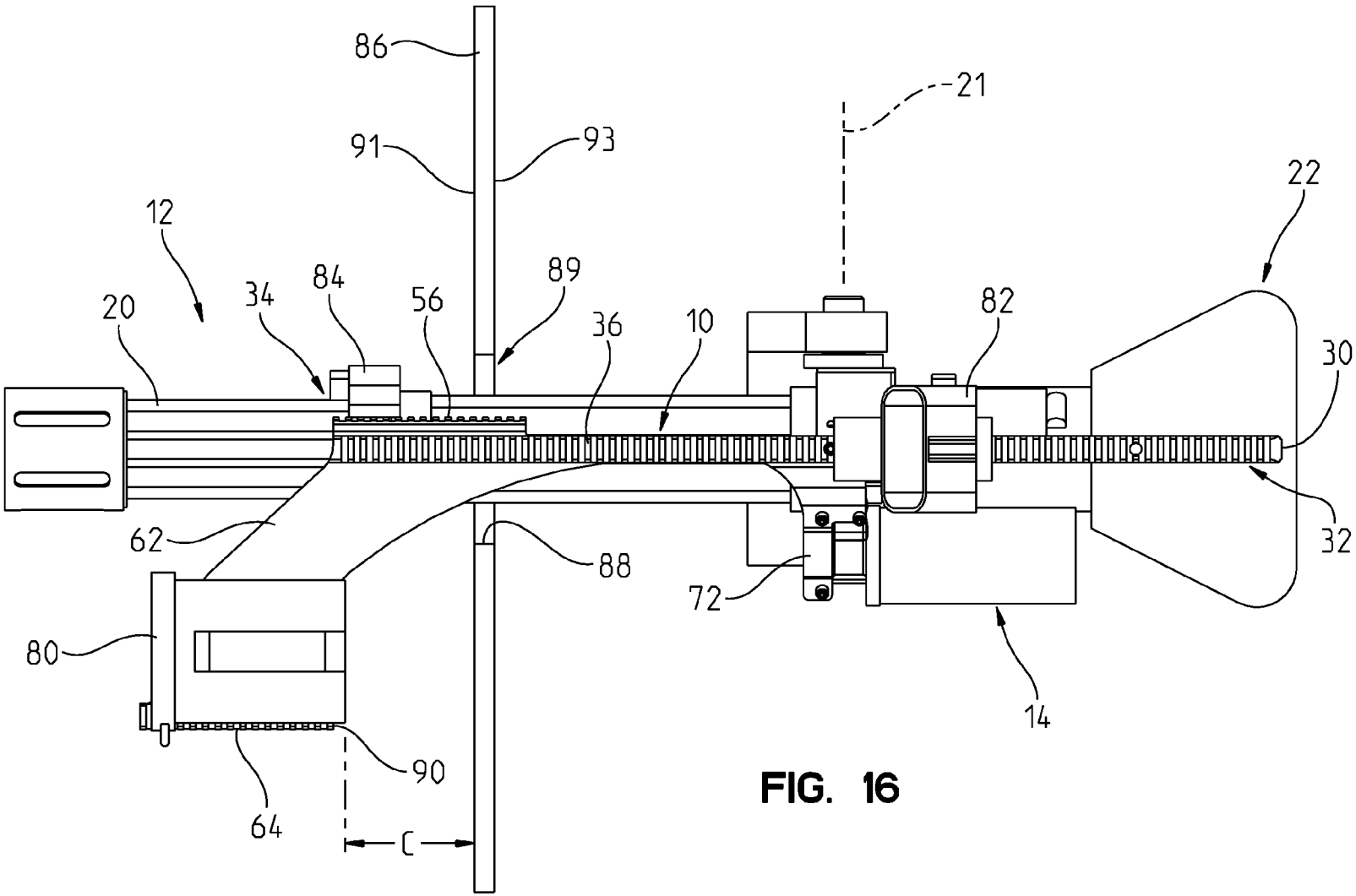
FIG. 16 is a top plan view of FIG. 15.

FIGS. 10, 15, and 16 show a protective shield 86 including a vertical slot 88 having an open upper end 89 for receiving the barrels 20 of the weapon 12 along with the portion of the adapter 10 positioned thereabove. The protective shield 86 is illustratively formed of steel and is configured to protect the gunner from small arms fire and explosive blasts. The weapon 12 is supported for pivoting movement within the slot 88. The mounting rails 64 and 66 of the tail 62 are supported on a first or distal side 91 of the protective shield 86, while the grip 22 (and hence gunner) is positioned on an opposite second or proximal side 93 of the protective shield 86. As such, the shield 86 reduces splash-back of light onto the gunner from illumination devices 80, 80' supported by mounting rails 64 and 66 proximate the distal end 34 of the beam 30.

The tail 62 extends longitudinally away from the beam 30 (i.e., distally) to prevent undesirable contact between accessories supported by the tail 62 and the shield 86 during pivoting movement of the weapon 12 about the horizontal axis 21 and within the slot 88. In one illustrative embodiment, length $L_5$ from the rear edge 90 of the tail 62 to the mounting portion 42 of the beam 30 is approximately 16 inches (FIG. 4). The tail 62 includes an inner edge 92 curved toward the distal end 34 as it extends away from the beam 30 for providing clearance from the shield 86 as the weapon 12 pivots within the slot 88. An outer edge 94 of tail 62 is also curved but has a different radius of curvature than the inner edge 92, thereby providing increased support at the beam 30 and also defining an enlarged base 96 to provide additional support to the lateral end of tail 62 supporting mounting rails 64 and 66. The adapter 10 is dimensioned to provide adequate clearance C (FIG. 16) between accessories mounted on the outboard mounting rails 64 and 66 and the shield 86 for allowing unimpeded pivoting movement of the weapon 12 about the horizontal axis 21. In one illustrative embodiment, the clearance C is approximately 5 inches. However, it should be appreciated that the clearance C will be dependent upon the type and configuration of shield 86, relative positioning to the weapon 12, and weapon movement stops as set by the user. With reference to FIGS. 15 and 16, the adapter 10 of the present disclosure permits the axes of the inboard mounting rails 36 and 56 for optical/aiming devices 82 and 84, and the axis of the firing barrel 20*a* to be in substantial vertical alignment as represented by $D_1$ and $D_2$ in FIG. 15. This alignment produces a lower height above the barrel 20*a* from typical conventional mounts which allows the use of limited adjustment ranges on existing aiming devices, thus permitting point zeroing of the device to specific ranges. Additionally, this also produces a "closer to the bore" parallel alignment of non-specific range zeroing to the firing barrel 20*a*. The cantilever design, based in a beam 30 of uniform strength, allows an illumination device 80 to mount on a horizontal axis closer to the firing barrel 20*a* (as represented by $D_3$ in FIG. 15) than typical conventional mounts, which aids in zeroing and aiming the illumination device. The design also allows for added strength after supporting the accessories. It permits for the positioning of all illumination devices 80, 80' forward of the protective shield 86, thus eliminating splash-back. Splash-back increases the chances of counter detection, resulting in the enemy's enhanced ability to identify the threat position. As shown in FIG. 13, the illumination device 80 is positioned on the distal side 91 of the shield 86 in laterally spaced relation to the slot 88. Illustratively the center of the illumination device 80 is laterally spaced from the axes 92*a*, 92*b* by distance $D_4$, which as shown is about 7 inches.

As shown in FIG. 9, the multi-plane surfaces of the mounting rails 36, 56, 64, and 66 support the simultaneous, in-line, and concurrent mounting and use of numerous accessories, such as optics, lights, and lasers. The rear extension or tail 62 of the adapter 10 allows the mounting of a current organic aiming device at the proper eye relief distance, thus allowing proper use of the device and negating reduction in engagement speed. The low profile of the adapter 10, as well as the adapter's ability to mount devices out of the user's field of view, increases situational awareness, field of view during engagement, and reduces shielding of threat detection. The low profile also reduces the "above bore" distance for light, sight, and laser correlation which supports a more accurate fire control system.

Figures 17, 18:
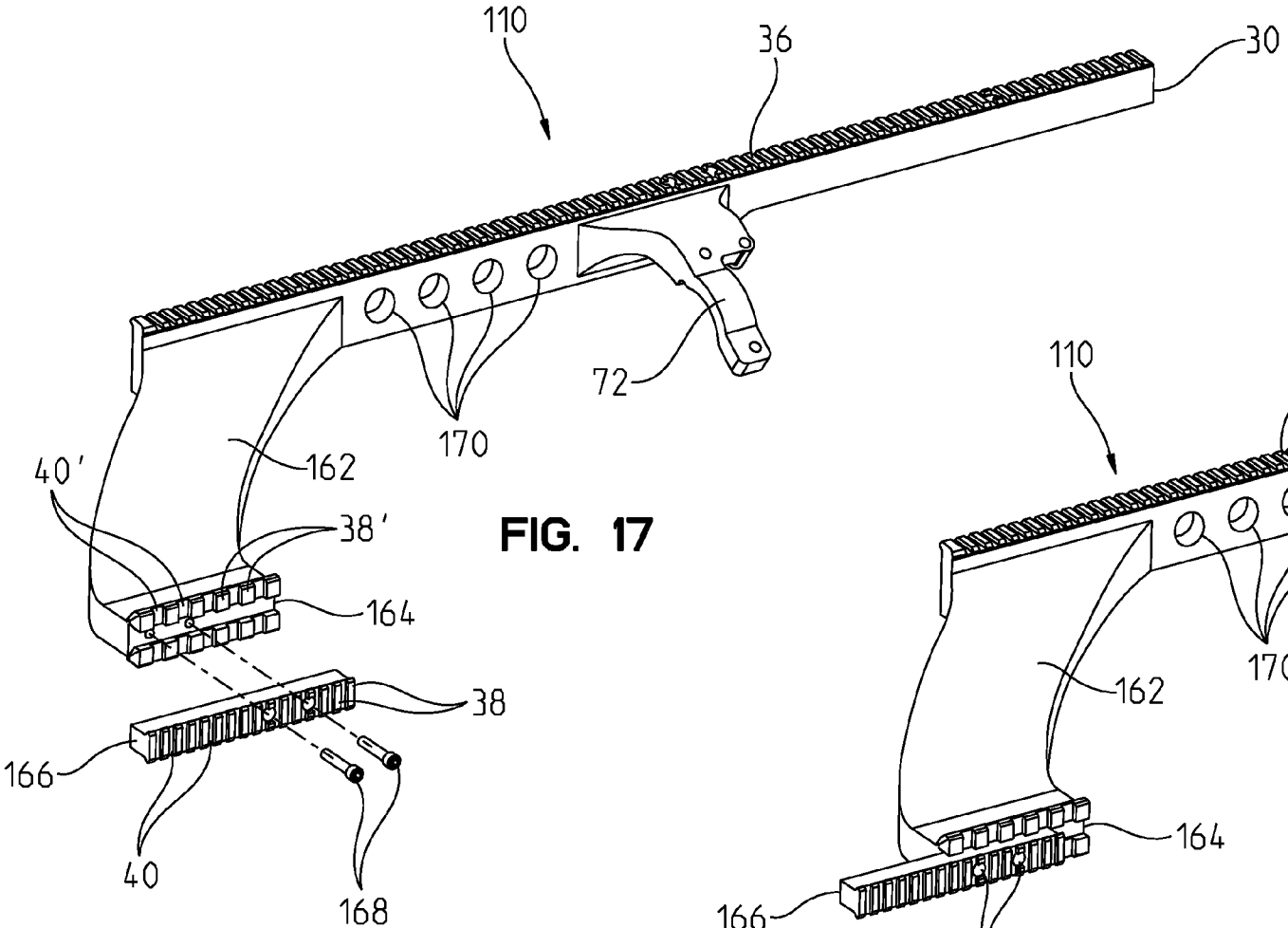
FIG. 17 is a perspective view similar to FIG. 11, showing a further illustrative adapter.
FIG. 18 is a detailed perspective view of the distal end of the adapter of FIG. 17.

FIGS. 17 and 18 illustrate a further illustrative adapter 110 including a tail 162 having an outboard rail 164 configured to couple with an adapter 166. More particularly, the outboard rail 164 may include a first mounting configuration (e.g. a customized configuration of ribs and slots 38' and 40'), while the adapter 166 may include a second mounting configuration (e.g. a Picatinny rail having ribs and slots 38 and 40 conforming to MIL-STD-1913). The adapter 166 is configured to be secured to the outboard rail 164 through conventional fasteners, such as bolts 168. Securing the adapter 166 to the outboard rail 164 provides the flexibility of converting between different mounting configurations. A plurality of openings 170 may extend transversely through the beam 30 and are configured to reduce the overall weight of the adapter 10.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An adapter for mounting on a weapon, the adapter comprising:

a beam extending longitudinally between opposing proximal and distal ends, the beam including an upper surface and a side surface;

a first inboard mounting rail supported by the upper surface of the beam;

a tail supported proximate the distal end of the beam, the tail including an arcuate body extending laterally outwardly and downwardly from the beam and conforming to the circumference of the weapon;

a first outboard mounting rail supported by the tail;

a stabilizing member positioned intermediate the proximal and distal ends of the beam, the stabilizing member including an arcuate arm extending laterally outwardly and downwardly from the beam and conforming to the circumference of the weapon; and at least one coupler securing the stabilizing member to the weapon.

2. The adapter of claim 1, further comprising a second inboard mounting rail positioned proximate the distal end of the beam, the second inboard mounting rail extending parallel to, and being angularly offset from, the first mounting rail.

3. The adapter of claim 1, wherein the beam includes a center portion intermediate the proximal and distal ends, the proximal and distal ends being cantilevered from the center portion of the beam.

4. The adapter of claim 1, wherein the tail extends longitudinally distally and vertically downwardly from the distal end of the beam.

5. The adapter of claim 1, wherein the first outboard mounting rail extends parallel to the first inboard mounting rail.

6. The adapter of claim 1, wherein the support is configured to mount to a machine gun including a plurality of circumferentially spaced, rotatable barrels.

7. The adapter of claim 6, wherein the arcuate arm of the stabilizing member includes a cutout to conform to the shape of a gear head of the machine gun.

8. The adapter of claim 1, further comprising a bearing member supported proximate the distal end of the beam.

9. The adapter of claim 8, wherein the bearing member includes a housing, and a pin spring biased outwardly from the housing.

10. The adapter of claim 1, further comprising a first accessory removably coupled to the first inboard mounting rail, and a second accessory removably coupled to the first outboard mounting rail.

11. The adapter of claim 10, wherein the first accessory comprises an optical sight and the second accessory comprises one of an illumination device, a laser designator, and a range finder.

12. The adapter of claim 1, wherein the proximal end of the beam is positioned on a first side of a protective shield, and the distal end of the beam is positioned on a second side of the protective shield.

13. The adapter of claim 12, further comprising an illumination device supported by one of the mounting rails on the second side of the protective shield.

14. The adapter of claim 13, wherein the illumination device is supported by the first outboard mounting rail supported by the tail.

15. The adapter of claim 1, further comprising a second outboard mounting rail supported by the tail and extending parallel to the first outboard mounting rail.

16. The adapter of claim 1, wherein each of the mounting rails includes a plurality of ribs, and a plurality of slots positioned intermediate adjacent pairs of the plurality of ribs.

* * * * *